United States Patent [19]

Gaunt

[11] Patent Number: 4,892,308

[45] Date of Patent: Jan. 9, 1989

[54] BOWLING BALL AND FINGER INSERT THEREOF

[76] Inventor: Ray P. Gaunt, P.O. Box 181, New Brighton, Pa. 15066

[21] Appl. No.: 258,636

[22] Filed: Oct. 17, 1988

[51] Int. Cl.[4] ..... A63B 37/00

[52] U.S. Cl. ..... 273/63 B

[58] Field of Search ..... 273/63 R, 63 A, 63 B, 273/63 E; 156/256; 29/428

[56] References Cited

U.S. PATENT DOCUMENTS

| | | | |
|---|---|---|---|
| 447,011 | 2/1891 | Harmon | 273/63 A |
| 553,011 | 1/1895 | Huntoon | 273/63 B |
| 1,021,490 | 3/1912 | Scully . | |
| 1,080,307 | 12/1913 | Sandheimer | 273/63 B |
| 2,210,528 | 8/1940 | Darby | 273/63 |
| 2,314,811 | 3/1943 | Akin | 33/174 |
| 2,372,959 | 4/1945 | Keith | 272/63 |
| 2,435,327 | 2/1948 | Seurynck | 273/63 |
| 2,436,976 | 3/1948 | Seurynck | 273/63 |
| 2,842,367 | 7/1958 | Keith | 273/63 |
| 2,950,111 | 8/1960 | Kunevicius | 273/63 |
| 3,004,762 | 10/1961 | Frost | 273/63 |
| 3,012,783 | 12/1961 | Bunk et al. | 273/63 |
| 3,129,002 | 4/1964 | Bednash | 273/63 B |
| 3,416,796 | 12/1968 | Ginder | 273/63 |
| 4,247,102 | 1/1981 | Seyler | 273/63 B |
| 4,560,162 | 12/1985 | Miller | 273/63 |
| 4,561,654 | 12/1985 | Hassa | 273/63 |

*Primary Examiner*—George J. Marlo
*Attorney, Agent, or Firm*—Stanley J. Price, Jr.

[57] ABSTRACT

A bowling ball has an oversized finger hole in which a rigid liner insert is secured. The rigid liner insert has an inner cylindrical bore with an internal threaded portion. A cylindrical finger receiving insert has an internal bore of a preselected diameter and an external cylindrical surface with external threads formed thereon. The finger receiving insert having an internal bore of a preselected diameter is threadedly secured in the liner insert to provide a bowling ball having a finger hole of a preselected diameter. The finger receiving insert may be threadably removed from the liner insert and another finger receiving insert with a different preselected diameter may be threadedly secured therein.

6 Claims, 3 Drawing Sheets

BOWLING BALL AND FINGER INSERT THEREOF

BACKGROUND OF THE INVENTION

1. Field of the Invention

This invention relates to a bowling ball and more particularly to a bowling ball having a removable finger insert and to a method of changing the inner diameter of a finger hole in a bowling ball.

2. Description of the Prior Art

Bowling balls having means to change the inner diameter of the finger holes are well known in the art. For example, U.S. Pat. No. 2,314,811 discloses an apparatus for determining the relative position of the finger and thumb holes in a bowling ball and includes insert members adjustably secured within the bowling ball.

U.S. Pat. No. 2,435,327 discloses a bowling ball with a insert sleeve having a base portion that has wall engaging elements that are moved into frictional engagement by an adjustment screw. The insert member is thus secured within the bowling ball hole only at the base of the oversized finger hole formed in the ball. In one embodiment, the insert has an internally corrugated surface to facilitate frictional gripping of the ball.

U.S. Pat. No. 2,436,976 also discloses an insert with a radially expansive device to frictionally engage the wall of the oversized finger hole at the base of the insert.

U.S. Pat. No. 2,842,367 has an insert secured in an oversized finger hole that contains air inflatable chambers to change the inner diameter of the insert.

U.S. Pat. No. 2,950,111 discloses an arcuate semicylindrical pad that is arranged to move radially within the finger hole by an adjusting screw to change the inner diameter of a portion of the hole.

U.S. Pat. No. 3,004,762 discloses an insert with a longitudinal split and an external flange against which an adjusting screw positioned transverse to the split rotation of the adjusting screw reduces and increases the split in the insert to thus increase and decrease the diameter of the finger hole. The adjusting screw does not extend radially and would appear to unbalance the ball.

U.S. Pat. No. 3,012,783 has an adjustable finger insert which includes a cylindrical insert secured in the finger hole with an internal threaded portion and an inturned upper flange. An adjusting nut is threadedly secured in the cylindrical insert. A flexible sleeve abuts the nut and the inturned upper flange in the insert so that rotation of the nut flexes the flexible sleeve to change the inner diameter of the finger hole.

U.S. Pat. No. 3,416,796 discloses a cylindrical insert that is moveable within a cylindrical sleeve secured in the bowling ball finger hole. The sleeve has an inturned wall with an inward taper and the insert has an external wall with an outward taper. A bolt is secured to the insert bottom wall and is threaded into the bowling ball. Rotation of the bolt moves the insert relative to the cylindrical sleeve to increase or decrease the inner diameter of the insert.

U.S. Pat. No. 4,560,162 has a liner with an off center finger hole an a flexible insert positioned therein. A screw in the liner abuts a flange on the insert and adjusts the diameter of the flexible insert.

U.S. Pat. No. 4,561,654 discloses a pair of insert tubes threaded to each other for rotation relative to each other and a finger receiving flexible tube is secured to the inner threaded insert. The flexible tube has a wedge shaped outer surface so that the insert tubes when rotated relative to each other change the internal diameter of the finger receiving tubes.

Substantially all of the prior art disclose inserts that have one or more flexible tubes which are flexed or compressed to change the diameter of the finger hole. Screws or other adjusting means are required and it is a trial and error method of obtaining the desired inner diameter of the finger hole insert because of the flexibility and compressibility of the insert. The flexible inserts also have the disadvantage of being compressible and frequent adjustment is required to compensate for the resilience of the inserts.

There is a need for a rigid finger insert that may be tested for proper diameter and fit outside of the bowling ball and quickly placed in a bowling ball of the desired weight and spacing for the fingers.

In public bowling establishments, frequently bowlers who do not have their own ball will try many bowling balls that are on the return racks in an effort find a bowling ball that has the desired weight, the desired spacing of the finger and thumb holes and thumb and fingers of the desired inner diameter.

With this invention, it is now possible to select the appropriate bowling ball with the desired weight and then select a finger hole insert of the desired inner diameter to obtain an optimum fit for the thumb and the other fingers if desired.

This invention also provides a means for a bowler having his own bowling ball to quickly change the inner diameter of the finger hole insert when the thumb swells and expands or shrinks and contracts during bowling.

Bowling balls are provided with one or more finger holes and a thumb hole. These holes are arranged to receive the thumb and one or more fingers of the bowler. Throughout the specification, the description of the invention will be directed to a thumb hole which will be referred to as a finger hole and it should be understood that the invention is intended to encompass, where desired, the ability to change the diameter of one or more of the finger holes and the thumb holes in the bowling ball. The embodiments are intended to illustrate the invention and are not intended to limit the invention to the changing of the diameter of any single hole.

SUMMARY OF THE INVENTION

In accordance with the invention, there is provided a bowling ball that has an oversized finger hole formed therein. A rigid liner insert having an outer surface and an inner cylindrical bore is adhesively secured in the oversized finger hole. The liner insert has an inner cylindrical bore with an internal threaded portion. A cylindrical finger receiving insert has an internal bore of a preselected diameter and an external cylindrical surface with external threads formed thereon. The finger receiving insert is threadedly secured in the liner insert and a means is provided to threadably remove the finger receiving insert from the liner insert and threadedly secure a second finger receiving insert having a different internal diameter in the liner insert.

The method of this invention for changing the inner diameter of a finger hole includes forming an oversized radially extending finger hole in a bowling ball. A cylindrical liner insert is adhesively secured to the wall of the oversized finger hole and the liner insert has an internal threaded bore. A plurality of cylindrical finger receiving inserts each having a bore with a different inner diameter and the same outer diameter and with the same dimensioned external thread portion are provided. The finger insert having a first preselected diameter is threadably removed from the cylindrical insert threaded bore and a second threaded finger insert is inserted and threadedly secured in the cylindrical liner to provide a bowling ball with a finger hole having a different liner diameter.

Accordingly, the principle object of this invention is to provide a bowling ball which has rigid inserts that may be threadedly removed therefrom to change the inner diameter of a finger hole.

Another object of this invention is to provide a rigid liner secured in an oversized finger hole with a bore having an internal threaded portion to receive a externally threaded finger insert. These and other objects of the present invention will be more completely disclosed and described in the following specification, the accompanying drawings and the appended claims.

BRIEF DESCRIPTION OF THE PREFERRED EMBODIMENTS

Figure 1:
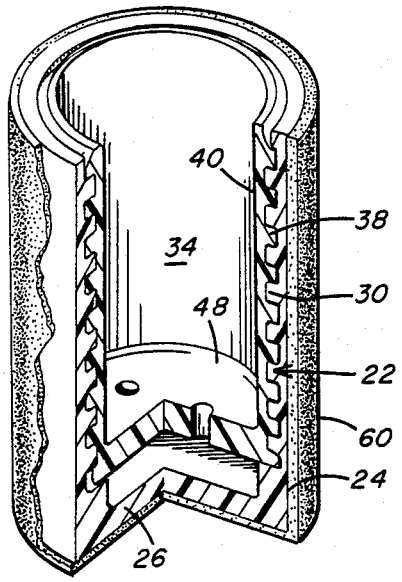
FIG. 1 is a perspective view partially in section of an assembled liner insert and finger receiving insert.
Figure 2:
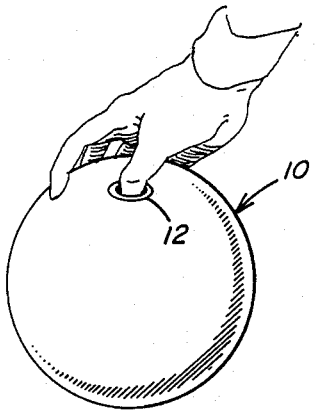
FIG. 2 is a perspective view illustrating a bowling ball with a thumb hole and the thumb positioned therein.
Figure 3:
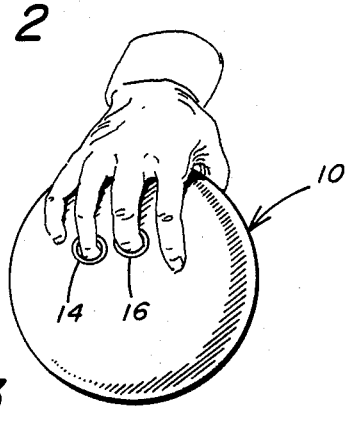
FIG. 3 is a perspective view of a bowling ball similar to FIG. 2 illustrating the finger holes with the fingers positioned therein.

Referring to the drawings and to particularly FIGS. 1 and 2, a bowling ball 10 is illustrated having a thumb hole 12 and in FIG. 3, the finger holes 14 and 16. It should be understood that throughout the specification, the term finger hole is used interchangably with the term thumb hole in the bowling ball 10 and where desired, both the thumb hole 12 and finger holes 14 and 16 may have the finger receiving inserts, later described, positioned therein. Where desired the finger receiving inserts may be used only in the thumb hole 12.

Figure 11:
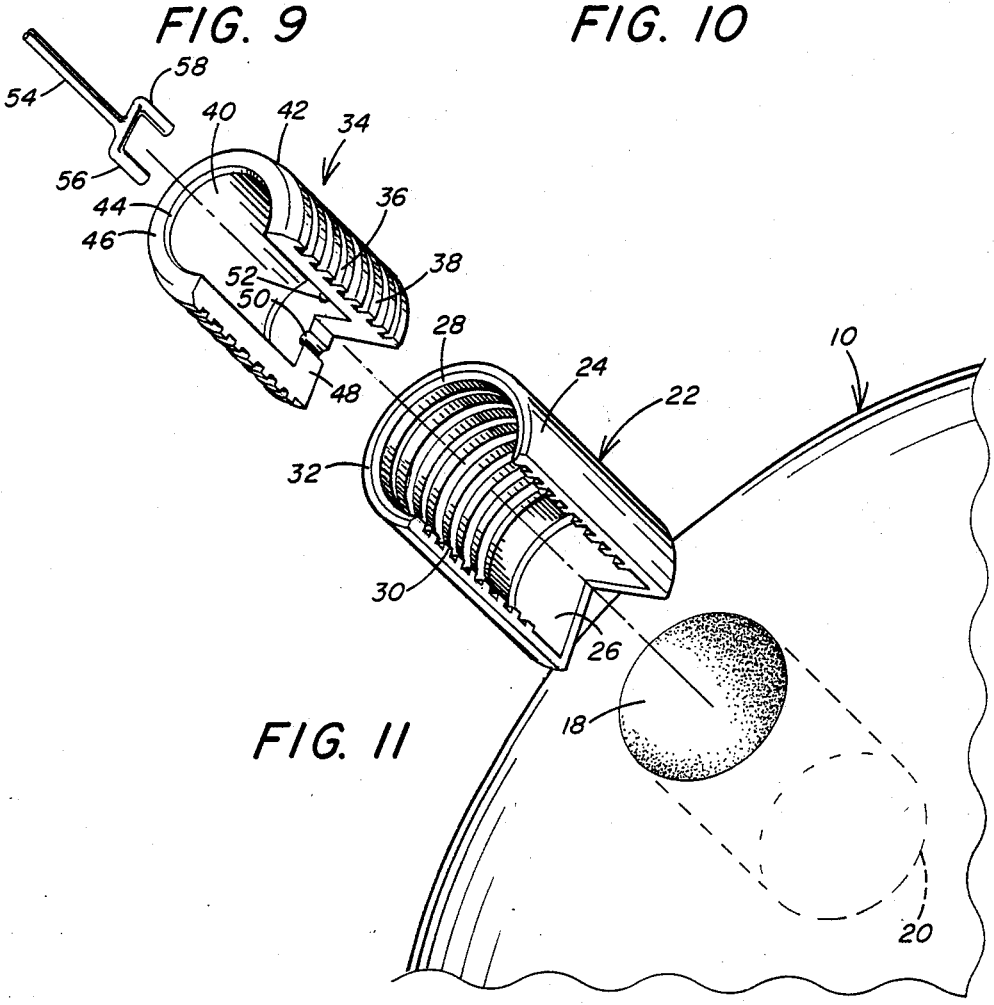
FIG. 11 is an exploded perspective view illustrating the oversized finger hole in the bowling ball with the adhesive on the finger hole wall, the liner insert, the finger receiving insert and the insert rod.

Referring to FIGS. 1 and 11, the bowling ball 10 has an oversized finger hole 18 drilled therein to a depth where base 20 is illustrated in dotted lines in FIG. 11. It should be understood, the base 20 may also have a conical configuration formed by the tip of the conventional drills used to form the oversized finger hole 18. The bowling ball is made of a suitable hard resin material such as resins sold under the trademarks "Ebonite" and "Bakelite".

A liner insert generally designated by the numeral 22 has a generally cylindrical configuration with a cylindrical outer surface 24 and a base portion 26 that closes the bottom end of the liner insert. The liner insert has an internal cylindrical bore 28 with internal threads 30 formed therein. The liner insert 22 is formed of a rigid plastic or resin material which has sufficient strength to form rigid internal threads therein. The threads are preferably spaced at a preselected distance to permit the finger receiving insert to be fixedly secured therein and yet to permit the easy insertion of the finger receiving insert. The liner insert is rigid and may be formed by any suitable forming process to include the inner threaded bore 28. The liner insert may be fabricated from a rigid material similar to the material used in the bowling ball or may be fabricated from other suitable resins such as nylon or the like.

Figure 9:
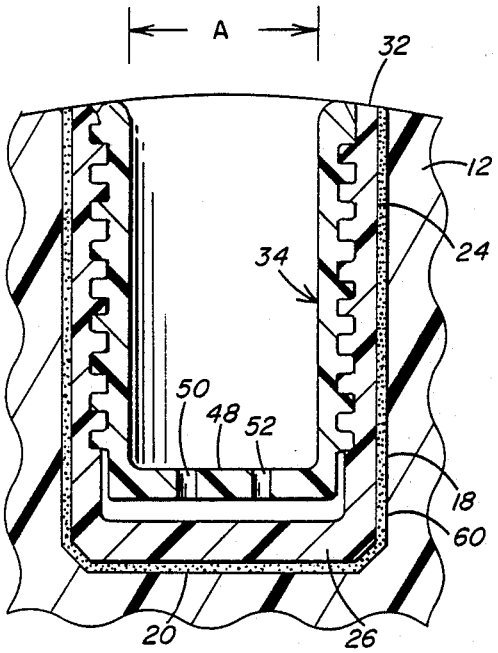
FIG. 9 is a view in section illustrating the liner insert and the finger receiving insert secured in the bowling ball where the finger receiving insert has an internal diameter A.
Figure 10:
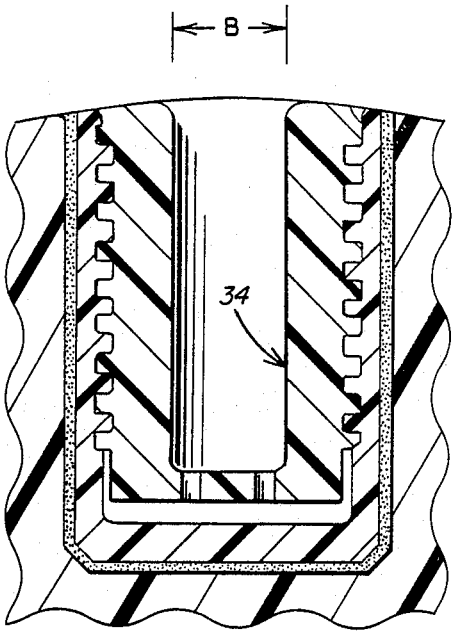
FIG. 10 is a view similar to FIG. 9 illustrating a finger receiving insert with a diameter B.

The liner insert 22 has a bevelled upper circular edge portion 32 which preferably has the contour of the bowling ball as illustrated in FIGS. 9 and 10.

A finger receiving insert generally designated by the numeral 34 has a cylindrical configuration with an outer cylindrical wall 36 with external threads 38 formed therein. The finger receiving insert has an internal bore 40 with a preselected internal diameter, as for example, diameters A or B, as illustrated in FIG. 9. The upper edge 42 of the finger receiving insert has an internal bevel 44 and an external arcuate circular surface 46 which has the contour of the bowling ball, as illustrated in FIGS. 9 and 10. The finger receiving insert 34 has a base portion 48 with a pair of longitudinal bores 50 and 52 therein.

The threads 38 on the finger receiving insert 34 are arranged to mate with the threads 30 in the liner insert 22 and the finger receiving insert 34 is fabricated of suitable rigid resin material which permits the finger receiving insert to be threadably secured within the liner insert and when secured therein to form a rigid two part insert.

A insert rod 54 has a pair of tines or prongs 56 and 58 which are spaced to be received in bores 50 and 52 of the finger receiving insert 34.

The two piece insert comprising the liner insert 22 and the finger receiving insert 34 are assembled in the bowling ball 10 in the following manner. A suitable adhesive 60 such as an epoxy resin, is applied to either the inner surface of the oversized finger hole drilled in the bowling ball 10 and/or on the outer cylindrical surface 24 of the liner insert 22.

The liner insert 22 is then inserted in the oversized finger hole 18 to adhesively and, preferably, permanently secure the liner insert 22 in the oversized finger hole 18. FIGS. 1, 9 and 10 illustrate the adhesive 60 between the wall of the oversized hole 18 and the outer cylindrical wall 24 of the liner insert 22. The liner insert 22 is so dimensioned that the upper edge portion 32 has the same arcuate contour as the bowling ball 10. As previously stated, the liner insert base portion 26 is generally planar as is the oversized finger hole base portion 20. It should be understood, however, that both the base portion 26 and the oversized finger hole base portion 20 may have a conical configuration.

The finger receiving insert liner insert 34 is inserted in the liner insert 22 by positioning the prongs 56 and 58 of insert rod 54 in the longitudinal bores 50 and 52 in the finger receiving insert base portion 48. The external threads 38 of finger receiving insert 34 are threaded into the mating internal threads 30 of the liner insert 22 by rotation of the insert rod 54 and thus the finger receiving insert 34. The finger receiving insert 34 is rotated until it bottoms out in the liner insert 22 to threadably secure the finger receiving insert 34 in the liner insert 22 and thus in the bore 18 in bowling ball 10.

As illustrated, the finger receiving insert 34 in FIG. 9, has an internal bore diameter of A. To replace the finger receiving insert 34, in FIG. 9, with the finger receiving insert 34 of FIG. 10, which has a smaller diameter B, the insert prongs 56 and 58 are positioned in bores 50 and 52 and the rod 54 is rotated in a counterclockwise direction to remove the finger receiving insert 34 from the liner insert 22. The finger receiving insert 34 of FIG. 10 having the diameter B is then threadably inserted in the inner bore 28 of liner insert 22 and bottom out as previously described to provide a finger hole having a diameter B. With this arrangement, the removal and replacement of the finger receiving insert is quickly accomplished and the finger receiving insert 34 is rigidly secured in the bowling ball 10 with the preselected diameter finger bore 40 therein.

Figure 4:
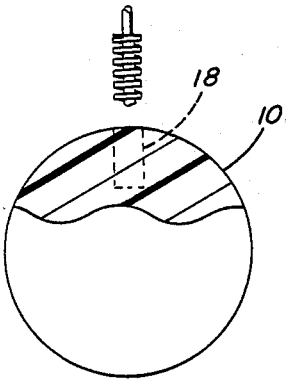
FIGS. 4–8 are diagrammatic views illustrating the bowling ball having the oversized finger hole formed therein, the liner insert being adhesively secured in the oversized finger hole, and the finger receiving insert threadedly secured in the liner insert.
Figure 5:
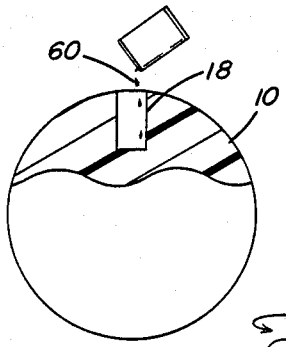
Figure 6:
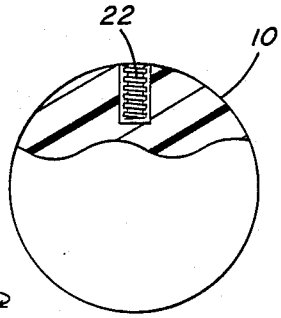
Figure 7:
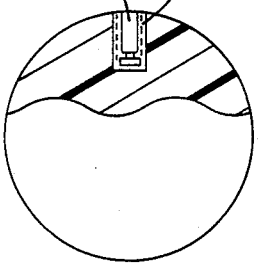
Figure 8:
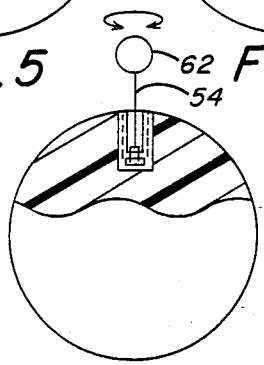

FIG. 4 illustrates the forming of the oversized finger hole 18 in the bowling ball 10 and FIG. 5 illustrates positioning an adhesive in the oversized finger hole 18. FIG. 6 illustrates the bowling bal 10 with the liner insert 22 positioned therein. FIG. 7 illustrates the finger receiving insert 34 positioned in the liner insert 22 and FIG. 8 illustrates the insert rod 54 with a handle 62 positioned in the bores in the base portion of the finger receiving insert 34.

Figure 12:
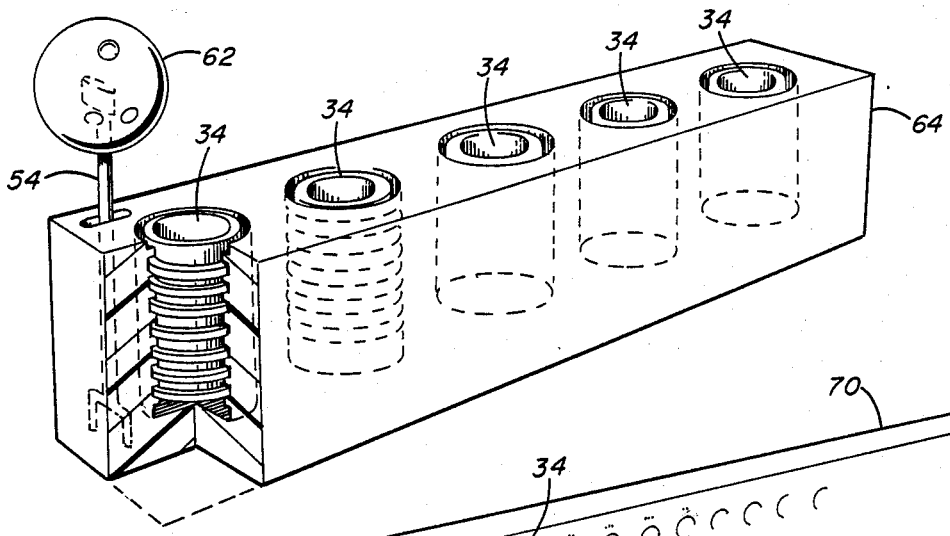
FIG. 12 is a perspective view of a kit in which the finger receiving inserts having different internal diameters are threadably secured in a holder and the insert rod is also positioned in the holder.

Referring to FIG. 12, there is illustrated a kit where one who has their own bowling ball may carry five finger receiving inserts 34 in a holder 64 with each of the finger receiving inserts having a different diameter of the internal bore 40. The insert rod 54 is carried in the kit 64 and preferably, the finger receiving inserts having different sized internal bores 40 are threaded into the holder 64.

Figure 14:
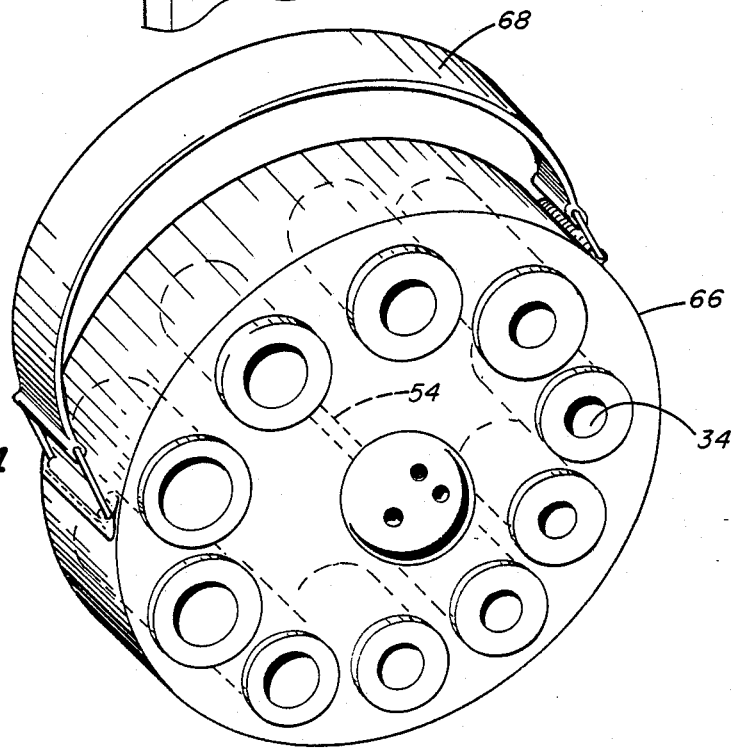
FIG. 14 is a view of a kit similar to the kit illustrated in FIG. 12.

In FIG. 14, a similar kit is illustrated as having a circular holder 66 with a plurality of finger receiving inserts 34 threaded therein and an insert rod 54 positioned in the holder 66. A handle 68 is provided for the holder 66. Although not illustrated, suitable marking meaning may be provided for each of the finger receiving inserts to designate the diameter of the internal bore 40.

Figure 13:
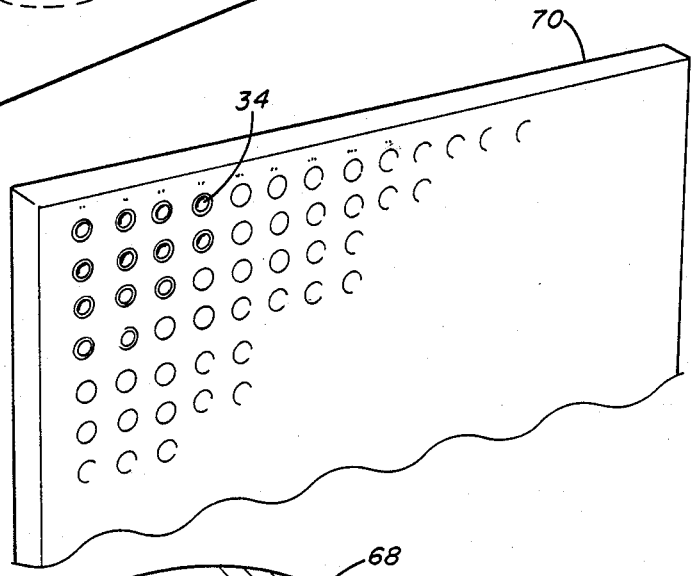
FIG. 13 is a fragmentary view of a board having finger receiving inserts positioned therein.

Referring to FIG. 13, there is illustrated a holder 70 for a large number of finger receiving inserts 34 that have a different diameter internal bores. With a holder such as board 70, the bowlers may select a finger receiving insert having the desired internal bore 40 and the bowling establishment operator can insert the finger receiving insert 34 in a ball selected by the bowler. Thus, the bowler has a choice of what ball he would prefer to use as far as weight and finger spacing is concerned and then has a choice of the diameter of the finger bore. With this arrangement, the inventory of balls used in a bowling establishment can be substantially reduced.

According to the provisions of the Patent Statutes, I have explained the principle preferred construction and mode of operation of my invention and have illustrated and described what I now consider to represent its best embodiment. However, it should be understood that, within the scope of the appended claims the invention may be practiced other than as specifically illustrated and described.

I claim:

1. A bowling ball having a variable internal diameter finger hole comprising, a bowling ball having an oversized cylindrical finger hole therein having the shape of a cylinder throughout its length, a rigid liner insert having the shape of a cylinder throughout its length and having a cylindrical outer surface and an inner cylindrical bore, said inner cylindrical bore having an internal threaded portion, means for adhesively securing said liner insert in said oversized finger hole, a cylindrical finger receiving insert having an internal bore of a preselected diameter and an external cylindrical surface with external threads formed thereon, said finger receiving insert threadedly secured in said liner insert, and means to threadably remove said finger receiving insert from said liner insert and threadably securing a second finger receiving insert having a different internal diameter in said liner insert.

2. A bowling ball having a variable internal diameter finger hole as set forth in claim 1 in which, said liner insert includes a base portion at one end, and means for adhesively securing said liner insert base portion to the base portion of said oversized finger hole formed in said bowling ball.

3. A bowling ball having a variable internal diameter finger hole as set forth in claim 1 in which, said finger receiving insert includes a base portion at one end, said base portion including means to engage an insert means for threadedly rotating said finger receiving insert in said liner insert.

4. A bowling ball having a variable internal diameter finger hole as set forth in claim 3 in which, said finger receiving base portion includes a pair of spaced longitudinal bores, said insert means includes a pair of spaced rods extending therefrom and arranged to extend into said longitudinal bores so that upon rotation of said insert means said finger receiving insert rotates relative to said liner insert.

5. A bowling ball with a variable inner diameter finger hole comprising, a bowling ball having at least one oversized radially extending finger hole formed therein having the shape of a cylinder throughout its length, a cylindrical rigid liner insert positioned i said finger hole, said liner insert having throughout its length a cylinder configuration with an outer cylindrical wall, a base portion, and an inner cylindrical wall with an internal thread formed therein along the length thereof, said liner insert outer cylindrical wall adhesively secured to said finger hole cylindrical wall, a cylindrical rigid finger receiving insert having a cylindrical bore of a preselected inner diameter and an outer cylindrical wall with an external thread along the length thereof, said finger receiving insert having an outer diameter substantially equal to said liner insert internal diameter so that said external threaded portion of said finger insert mates with said internal threaded portion of said liner insert to threadedly secure said finger receiving insert in said liner insert, said finger receiving insert having a bottom base portion with a pair of longitudinal apertures therein, and an insert rod having a pair of spaced engaging portions arranged to be positioned in said base portion longitudinal apertures so that upon rotation of said insert rod said finger receiving insert is rotated relative to said liner insert to threadably remove said finger receiving insert from said liner insert so that a finger insert having a different preselected inner diameter may be threadedly secured in said liner insert and thus change the inner diameter of said bowling ball finger hole.

6. A method of changing the inner diameter of a finger hole in a bowling ball comprising, forming an oversized radially extending finger hole having the shape of a cylinder throughout its length in a bowling ball, adhesively securing a liner insert having the shape of a cylinder throughout its length and an internal threaded bore to the wall of said oversized finger hole, providing a plurality of cylindrical finger receiving inserts each having a bore with different inner diameters and the same outer diameter with the external threaded portions of the same dimension, threadably removing a finger insert having a first preselected diameter from said cylindrical insert threaded bore, and inserting and threadedly securing a finger receiving insert having a second preselected diameter in said threaded bore of said liner insert to provide said bowling ball with a finger hole having a different inner diameter.

* * * * *